United States Patent [19]

Okuda et al.

[11] 4,023,152

[45] May 10, 1977

[54] IONIZATION TYPE SMOKE SENSING DEVICE

[75] Inventors: Yoshihiko Okuda, Hirakata; Tsunehiko Araki, Ashiya; Shigeru Matsumoto, Seto, all of Japan

[73] Assignee: Matsushita Electric Works, Ltd., Osaka, Japan

[22] Filed: Apr. 28, 1975

[21] Appl. No.: 572,315

Related U.S. Application Data

[63] Continuation-in-part of Ser. No. 402,182, Oct. 1, 1973, abandoned, which is a continuation of Ser. No. 191,636, Oct. 22, 1971, abandoned.

[52] U.S. Cl. ..... 340/237 S; 250/381

[51] Int. Cl.[2] ..... G08B 17/10

[58] Field of Search ..... 340/237 S; 250/381, 250/382, 384, 385, 390; 313/54; 324/33

[56] References Cited

UNITED STATES PATENTS

| | | | |
|---|---|---|---|
| 2,761,976 | 9/1956 | Obermaier et al. | 313/54 X |
| 3,047,847 | 7/1962 | Marsh et al. | 340/237 S X |
| 3,295,121 | 12/1966 | Meyer | 340/237 S |
| 3,603,949 | 9/1971 | Walthard | 340/237 S X |
| 3,676,680 | 7/1972 | Scheidweiler et al. | 340/237 S X |
| 3,714,641 | 1/1973 | Scheidweiler | 340/237 S |
| 3,728,703 | 4/1973 | Burnett | 340/237 S |

*Primary Examiner*—Donald J. Yusko
*Assistant Examiner*—Daniel Myer
*Attorney, Agent, or Firm*—Leydig, Voit, Osann, Mayer & Holt, Ltd.

[57] ABSTRACT

A smoke sensing device of the type having a single ionization chamber wherein stability and reliability are increased by driving the ionization chamber from a square wave oscillator, and utilizing an A.C. amplifier responsive to the ionization current within the chamber. The A.C. amplifier serves to amplify the current through the ionization chamber and couple the amplified current to a rectifier and detector adapted to respond to decreases in current, such as caused by smoke particles within the ionization chamber, to activate an alarm device.

3 Claims, 10 Drawing Figures

IONIZATION TYPE SMOKE SENSING DEVICE

This application is a continuation-in-part of our prior application Ser. No. 402,182 filed Oct. 1, 1973, itself a continuation of our application Ser. No. 191,636 filed Oct. 22, 1971 both now abandoned.

This invention relates to ionization smoke sensing devices, and particularly to an improved device utilizing A.C. techniques for increasing the stability and reliability thereof.

Ionization type smoke sensing devices are known, a typical configuration being illustrated in FIG. 1. Such device includes a reference ionization chamber $C_1$ having a pair of electrodes 2*a* and 3*a*, and a radioactive source 1*a* associated therewith. The chamber $C_1$ is sealed, and is generally configured to operate in a saturated current range having a constant current characteristic, and exhibiting a very high impedance. A sensing ionization chamber $C_2$ is provided, having electrodes 2*b* and 3*b* associated with a radioactive source 1*b*, the sensing chamber being open to ambient atmosphere thereby to allow smoke to enter the chamber. The reference and sensing chambers are coupled in series across a D.C. voltage source supplied, for example, by battery $V_0$. During normal operation, the potential at junction G assumes a predetermined value. In the presence of smoke, however, the smoke particles which enter the open sensing chamber $C_2$, decrease the current flow between electrodes 2*b* and 3*b*, causing a decrease in the voltage at junction G. Such decrease in voltage is sensed by a switching circuit $S_0$ which serves to activate an alarm circuit in response thereto.

In conventional devices of this sort, the ionization current within the sensing chamber $C_2$ is maintained at a value less than several hundred pA. This restriction is imposed by the sensitivity of the device to smoke, the dimensional limitations upon the chamber itself, and the magnitude of the voltage source $V_0$ used. As a consequence, the impedance of the reference ionization chamber, as seen by the switching circuit must be extremely high, typically on the order of $10^{11}$ ohms. In order to obtain a sufficient voltage swing at the junction G, the impedance of the reference chamber must be comparably high. It will be apparent, therefore, that if the insulation resistance of the respective chambers is degraded, the reliability of the device suffers. This factor is especially important in the sensing chamber $C_2$ which is open to the atmosphere. A further limitation of such prior art sensors is the requirement for a special amplifying device within the switching circuit $S_0$, necessitated by the small currents passed through the ionization chambers and the relatively small voltage swing at the junction G. It is noted that certain other prior art smoke sensors have attempted to replace the reference chamber $C_1$ with a simple resistor; these devices are similarly limited by a relatively small D.C. voltage variation at the junction G, a required high impedance for the sensing chamber and the attendant insulation resistance problems.

In view of the foregoing, it is a general aim of the present invention to provide a smoke sensing device utilizing a single ionization chamber wherein the impedance of such chamber is considerably lower than has heretofore been possible. In accomplishing the foregoing, it is an object of the invention to provide an ionization type smoke sensing device wherein a single ionization chamber is driven from a square wave oscillator, and the resultant A.C. ionization current is amplified and sensed to detect the presence of smoke or the like.

A principal object of the present invention is to provide a smoke sensing device which, although low in cost, is high in reliability. In accomplishing the foregoing, it is an object to utilize an A.C. amplifier of simplified construction for responding to the current within the ionization chamber.

Other objects and advantages will become apparent from the following detailed description, when taken in conjunction with the drawings, in which.

While the invention will be described in connection with a preferred embodiment, it will be understood that there is no intent to limit it to that embodiment. On the contrary, the intent is to cover all alternatives, modifications and equivalents included within the spirit and scope of the invention as defined by the appended claims.

Figure 4A:
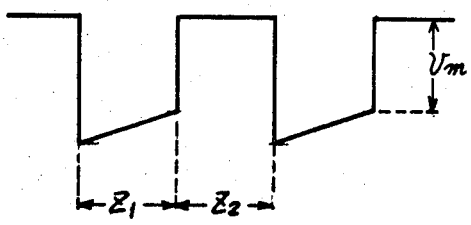
FIGS. 4A–4G illustrate wave forms within the circuit of FIG. 3.
Figure 4B:
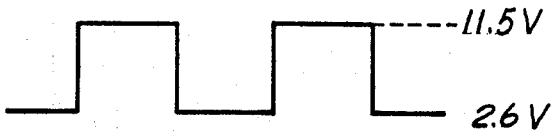

Turning now to the simplified block diagram of FIG. 2, the interrelationship of the various elements of a smoke sensing device exemplifying the present invention will be described. An ionization chamber I, open to the ambient atmosphere, has a positive electrode 4*a* and a negative electrode 4*b*. Electrode 4*a* is coupled to an oscillator O which is adapted to generate a square wave voltage as illustrated in FIG. 4B. The negative electrode 4*b* is coupled to a resistor 6, which, in turn, is coupled to ground so that a signal related to the A.C. ionization current is developed across resistor 6. An A.C. amplifier A has its input coupled to the junction between the negative electrode 4*b* and the resistor 6 so as to amplify the alternating ionization current. Connected to the output of the A.C. amplifier is a rectifying and smoothing circuit R adapted to provide a D.C. voltage having a magnitude related to the alternating ionization current. A switching cicruit S is coupled to the rectifying and smoothing circuit R for responding to the D.C. level produced thereby. The switching circuit S drives a responsive device X adapted to sound an alarm or provide an indication in response to the detection of smoke by the above described circuitry. More specifically, when smoke enters the ionization chamber, the ionization current therethrough will decrease, causing a decrease in the current coupled by the A.C. amplifier A to the rectifying and smoothing circuit R, causing a decrease in the D.C. signal produced by the circuit R, activating the switching circuit S and driving the responsive device X into an alarm condition.

Figure 1:
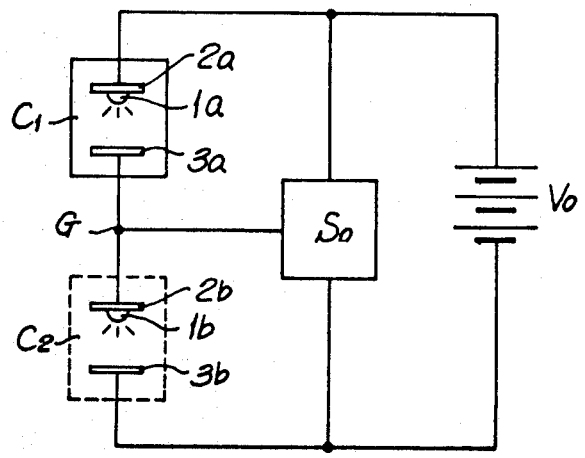
FIG. 1 PRIOR ART
FIG. 1 is a schematic diagram illustrating a conventional smoke sensing device of the ionization type.
Figure 2:
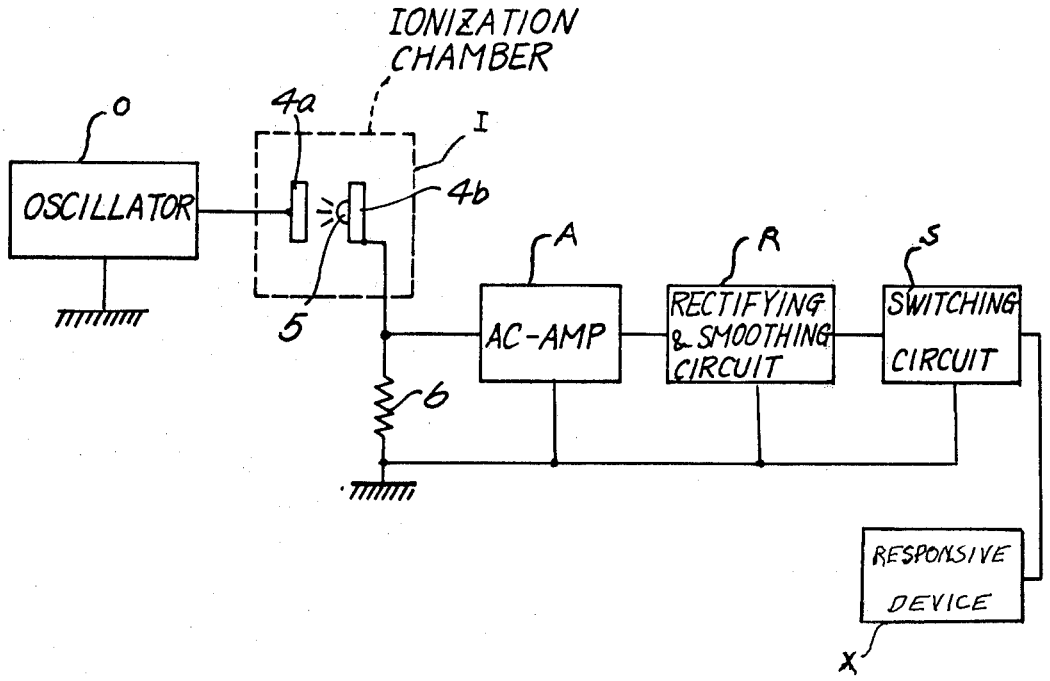
FIG. 2 is a simplified block diagram illustrating the major elements of a smoke sensing device exemplifying the present invention.
Figure 3:
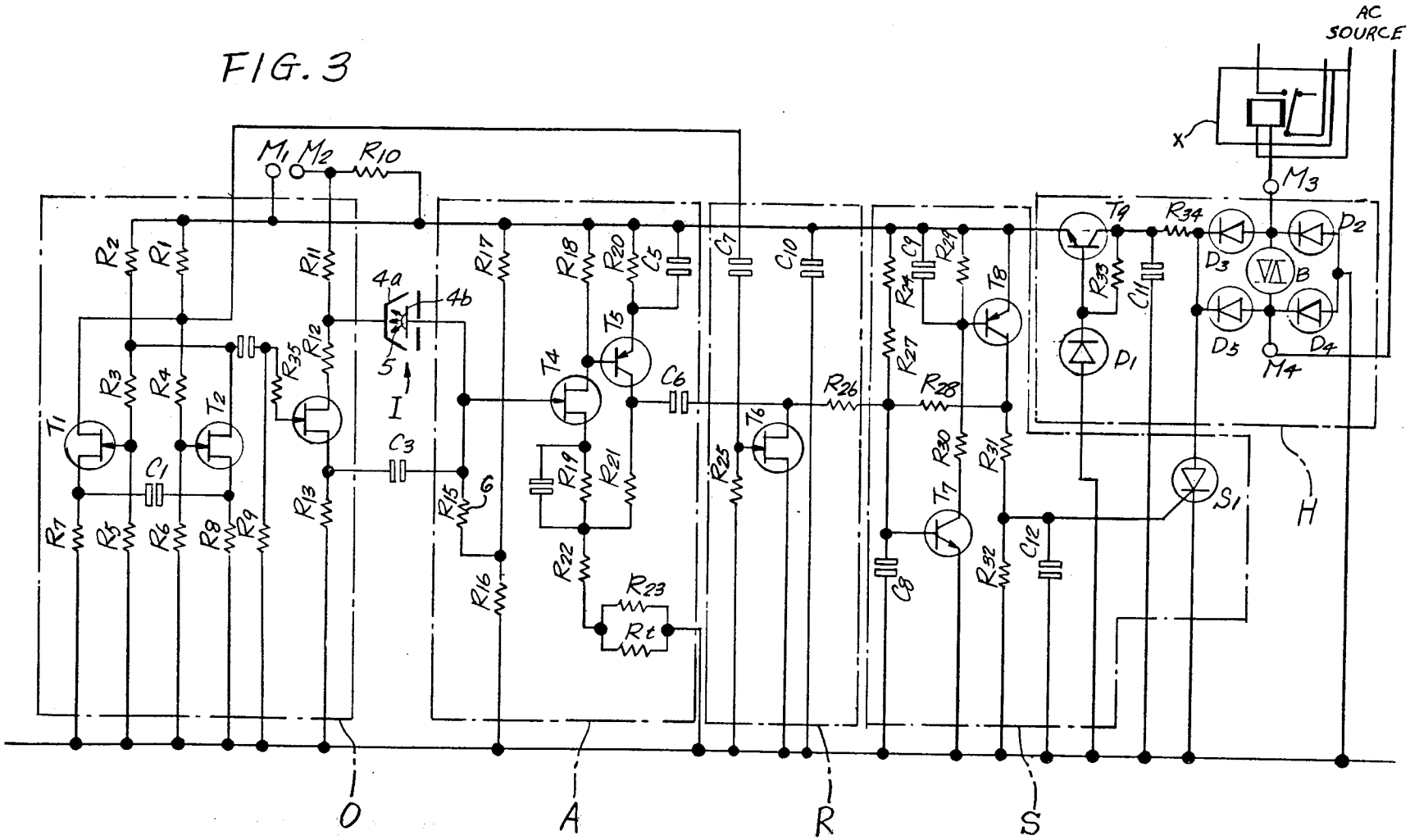
FIG. 3 is a schematic diagram of the smoke sensing device of FIG. 2.
Figure 4C:
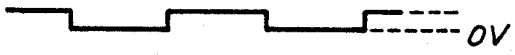
Figure 4D:
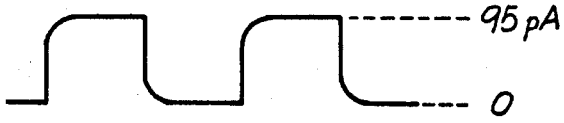
Figure 4E:
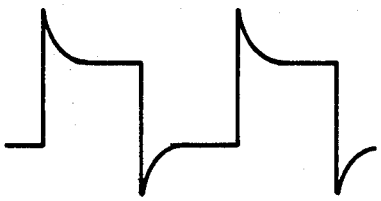
Figure 4F:
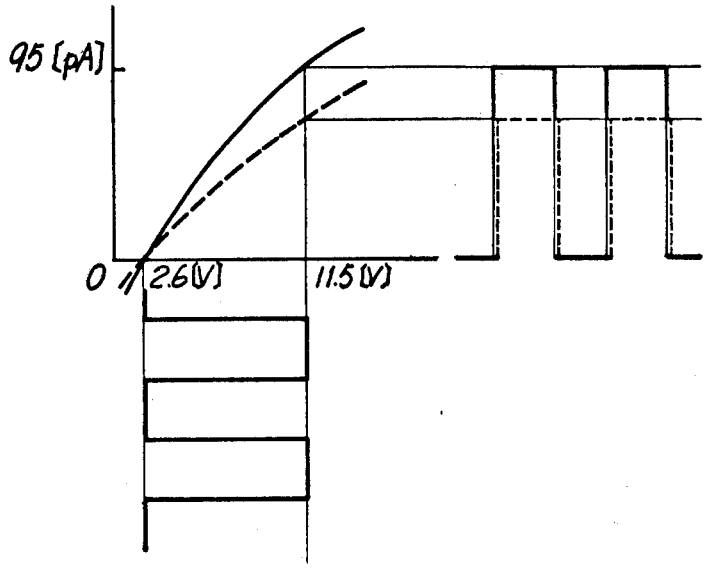

Turning now to FIG. 3, there is shown a detailed schematic diagram illustrating one embodiment of the smoke detector of FIG. 2. An oscillator, generally indicated at O, includes a pair of junction FETs connected as a source coupled astable multivibrator adapted to oscillate at a frequency such as 11 Hz. The output signal, taken at the drain of transistor $T_2$ is illustrated in FIG. 4A, and has a duty cycle of about 50%. A wave shaping circuit including transistor $T_3$ is responsive to the output of the multivibrator for producing an output signal of substantially perfect square waves having a duty cycle of 50%, as shown in FIG. 4B. Such signal is coupled to the positive electrode *4a* of the ionizaton chamber I. A pair of resistors $R_{16}$ and $R_{17}$, coupled across the power supply form a junction therebetween which is maintained at a predetermined voltage. A resistor $R_{15}$ couples the negative electrode *4b* of the ionization chamber I to such junction, serving the function of resistor 6 in FIG. 2 for developing the A.C. output signal responsive to the alternating current through the ionization chamber. An unavoidable electrostatic capacity of about 0.3 pF exists between the electrodes *4a* and *4b*. Such capacitance would tend to cause voltage spikes at the rising and falling edges of the oscillating wave form applied to the electrodes, such spikes being illustrated in FIG. 4E. In order to eliminate the spikes, a voltage reversed in phase to that applied to the positive electrode *4a* (as shown in FIG. 4C) is applied to the negative electrode *4b*. Such voltage is taken from the source of transistor $T_3$ via a capacitor $C_3$ and coupled to the electrode *4b* as shown. As a result, the current through the ionization chamber I takes the form illustrated in FIG. 4D. More specifically, in the illustrated embodiment, the voltage applied to the positive electrode *4a* is alternated between approximately 11.5 and 2.6 volts at a 50% duty cycle. A constant voltage of approximately 2.7 volts is maintained on the negative electrode *4b*. As a result, current pulses of substantially square wave form, and having an amplitude of approximately 95 pA will be passed through the ionization chamber as shown in FIG. 4D, and the solid line portion of FIG. 4F. However, when smoke enters the ionization chamber I, the voltage-current characteristic will change as illustrated in the dotted line portion of FIG. 4F. It is seen that the alternating ionization current decreases, for example, to about 70% of its initial value with a smoke of light dimming rate of 10% per meter. The ionization current in the absence of smoke will produce a voltage of about 9.5 millivolts (peak to peak) across the resistance $R_{15}$, such resistance having a comparatively low value of 100 M ohms. Similarly, the voltage across resistor $R_{15}$ will be lowered when the ionization current through the chamber decreases as a result of smoke therein. The terminals $M_1$ and $M_2$ are provided for testing the sensitivity of the device.

In practicing the invention, an A.C. amplifier A of relatively simple configuration is provided for responding to the alternating current passed through the ionization chamber I. Transistors $T_4$ and $T_5$, form a two stage A.C. amplifier of common source-common emitter configuration. In order to stabilize the gain, and compensate for temperature variations, a negative feedback path is provided including resistor $R_{21}$ operating in conjunction with resistors $R_{22}$, $R_{23}$ and thermistor $R_t$. The components within the amplifying circuit A may be arranged to produce an output current which is approximately 200 times the current within the ionization chamber I coupled thereto.

Figure 4G:
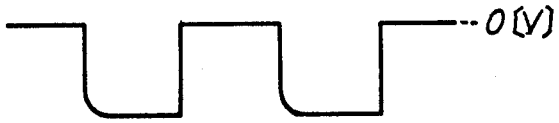

In practicing the invention, a rectifier R responds to the current produced by the amplifier A to generate a D.C. signal having a level related to the alternating current within the ionization chamber 1. The rectifier is of the synchronous variety, including a transistor $T_6$ adapted to be alternately conductive and non-conductive in accordance with the signal produced by the oscillator O. It is seen that the gate of transistor $T_6$ is coupled via a capacitor $C_7$ to the drain of transistor $T_1$. In the conducting half period, that is, the half period in which the drain of transistor $T_1$ is at a positive level, the drain of transistor $T_2$ will be negative causing the positive electrode *4a* in the ionization chamber I to be positive. In such conditions, ionization current will flow causing the output of amplifier A, taken at the collector $T_5$ to be positive. In this condition, the signal provided to the gate of transistor $T_6$ will maintain such transistor conductive, causing the amplifier A to pass a current proportional to the ionization current through capacitor $C_6$ and transistor $T_6$ to circuit common. Accordingly, capacitor $C_6$ will charge in dependence upon the magnitude of the ionization current. In the non-conducting half period of the oscillator O, current flow through the ionization chamber I ceases, and additionally the driving signal is removed from transistor $T_6$. Accordingly, the voltage on capacitor $C_6$ smoothed by the resistance $R_{26}$ and capacitor $C_8$ will be applied to the switching circuit S. Because the capacitor $C_6$ was charged positively on its left electrode, when transistor $T_6$ switches off, the voltage applied to the switching circuit S will be negative. For example, when no smoke is present in the ionization chamber a voltage of approximately −1.9 volts, such as shown in FIG. 4G, will be applied to the switching circuit. This negative D.C. voltage will be added to a positive voltage coupled through resistors $R_{27}$ and $R_{24}$. The values of the various resistors are selected so that in the absence of smoke the sum of the voltages, as seen at the base of transistor $T_7$ is below the switching threshold thereof, such as at approximately 0.3 volts. However, when smoke enters the ionization chamber I, the amplified and rectified ionization current will decrease, causing the summed voltages to rise, ultimately exceeding the threshold level of transistor $T_7$ and causing such transistor to conduct.

it should be noted that the synchronous rectification techniques described above are particularly advantageous in a smoke sensing device of the illustrated type. It has been found that the ionization current is likely to be influenced by wind or the like, and if a normal diode rectifier were used undesirable components caused by the wind would appear in the rectified output. However, utilizing the synchronous techniques, the rectifier is active only when the ionization chamber is in its conductive half cycle, eliminating the effect of wind.

Returning to the switching circuit S, it is seen that the collector of the transistor $T_7$ is coupled to the base of a transistor $T_8$. Accordingly, when transistor $T_7$ is driven into conduction, transistor $T_8$ similarly conducts and provides gating current to a thyristor $S_1$. A resistor $R_{28}$ coupled between the collector of transistor $T_8$ and the base of transistor $T_7$ provides a regenerative action and latches the transistors into conduction. When the base voltage applied to the transistor $T_7$ is less than the threshold switching voltage thereof (due to normal ionization current in the chamber I) both transistors $T_7$ and $T_8$ will be maintained in their cut off condition. However, when smoke in the chamber I decreases the current flow therethrough, the magnitude of the negative voltage produced by the rectifier R decreases, raising the voltage at the base of transistor $T_7$. When such voltage exceeds the switching threshold thereof, both transistors $T_7$ and $T_8$ switch into conduction, triggering the thyristor $S_1$ into conduction.

In the FIG. 3 embodiment, H illustrates a regulated power supply for providing D.C. voltages to the remaining circuitry. The thyristor $S_1$ operates in crowbar fashion across the power supply to place a clamp across such output. In such embodiment the responsive device X is coupled between the A.C. source and the input of the bridge rectifier comprised of diodes $D_2$–$D_5$. During normal operation, the minimal current drawn by the remaining circuitry is passed from the A.C. source through the responsive device X which may comprise a simple relay, the coil of which is illustrated at $X_1$. Such relatively light current is incapable of operating the relay. However, when the current within the ionization chamber I decreases to the extent necessary to trigger the thyristor $S_1$, the output of the bridge rectifier is shorted through the thyristor, increasing the current drawn from the A.C. source through the relay coil $X_1$, energizing the relay. Accordingly, the contacts $X_2$ are closed, such contacts being used to activate the particular alarm device associated with the smoke sensor.

It will now be appreciated that in accordance with the present invention a periodically varying voltage is applied to the electrodes of an ionization chamber, causing an alternating current therethrough. Such current is A.C. amplified to bring it to a workable level, and the amplified current is rectified to produce a voltage having a D.C. level related to the current within the ionization chamber. The advantages of such a system, when compared to prior devices adapted to amplify a direct ionization current and sense very small changes therein will be apparent. In the instant system, even a slight change in the A.C. ionization current can be amplified and accurately sensed. At the same time, the ionization chamber may be constructed to exhibit an equivalent resistance of approximately $10^8$ ohms, as compared with prior devices requiring an impedance of approximately $10^{11}$ ohms. Accordingly, the severe design requirements needed to retain the insulation resistance of the chamber are relaxed. The device may thus be constructed with a resistor of relatively low value replacing the reference ionization chamber of prior devices, and still providing characteristics far superior to such devices.

We claim as our invention:

1. A smoke sensing device comprising in combination, a single ionization chamber including a pair of opposed electrodes exposed to the ambient atmosphere, a radioactive source associated with the electrodes and capable of ionizing the air between the electrodes, a load resistor coupling one of said electrodes to a reference potential, square wave oscillator means coupled to the other of said electrodes for causing a square wave ionization current to flow between said electrodes and through said load resistor, an A.C. amplifier coupled to the resistor for producing an alternating output signal proportional to said ionization current, a rectifier coupled to the amplifier for producing a direct voltage output signal which varies in accordance with the magnitude of said ionization current, and means coupled to the rectifier and responsive to said direct voltage output signal for switching to an alarm condition when said ionization current decreases due to the presence of smoke particles between the electrodes.

2. The smoke sensing device as set forth in claim 1 wherein the rectifier includes switch means driven by said oscillator to be on and off in synchronism with said square wave for synchronizing the operation of said rectifier with the square wave produced by said oscillator.

3. The smoke sensing device as set forth in claim 1 including a capacitor connected to the output of said amplifier, said rectifier comprising switch means connected to the capacitor and driven by the oscillator to be alternately conductive and non-conductive in synchronism with the square wave for charging said capacitor when conductive and for imposing the charge on said capacitor onto said means for switching to an alarm condition when non-conductive, thereby to synchronize operation of said rectifier with said square wave.

* * * * *